US007172539B1

(12) United States Patent
Bythewood et al.

(10) Patent No.: US 7,172,539 B1
(45) Date of Patent: Feb. 6, 2007

(54) ABDOMINAL EXERCISING SUPPORT APPARATUS

(76) Inventors: Alice Bythewood, 520 Franklin Ave., suite L19, Garden City, NY (US) 11530; Daniel W Bythewood, 520 Franklin Ave., suite L19, Garden City, NY (US) 11530; Gary Anderson, 45 Sunset Ave., Wheatley Heights, NY (US) 11798; Laurie Anderson, 45 Sunset Ave., Wheatley Heights, NY (US) 11798

( * ) Notice: Subject to any disclaimer, the term of this patent is extended or adjusted under 35 U.S.C. 154(b) by 0 days.

(21) Appl. No.: 10/750,644

(22) Filed: Jan. 2, 2004

(51) Int. Cl.
*A63B 26/00* (2006.01)
*A63B 71/00* (2006.01)

(52) U.S. Cl. ..... 482/140; 482/907; 482/91

(58) Field of Classification Search ..... 482/91, 482/140, 907–908, 135, 121–129; D21/676, D21/686, 690, 692; 297/61, 92, 230.1, 230.14, 297/284.1, 299, 292–293, 300.4–300.7, 301.1–301.7, 297/391, 394, 400, 406
See application file for complete search history.

(56) References Cited

U.S. PATENT DOCUMENTS 3,712,672 A * 1/1973 De Graaf ..... 297/301.4
4,836,531 A * 6/1989 Niks ..... 482/44
4,988,145 A * 1/1991 Engel ..... 297/300.4
5,441,473 A 8/1995 Safani et al.
5,492,520 A 2/1996 Brown
5,545,114 A 8/1996 Gvoich
5,725,463 A 3/1998 Colonello et al.
5,728,035 A 3/1998 Sands
5,730,688 A * 3/1998 Prusick ..... 482/130
5,807,220 A 9/1998 Allis et al.
5,871,425 A 2/1999 Gvoich
5,888,181 A 3/1999 Yeh
5,931,768 A 8/1999 Amesquita
6,090,023 A 7/2000 Liu
6,312,366 B1 11/2001 Prusick
6,932,431 B2 * 8/2005 Koch et al. ..... 297/301.5
2003/0176263 A1 * 9/2003 Parmater
2004/0067830 A1 * 4/2004 Rovere et al. ..... 482/140

* cited by examiner

*Primary Examiner*—Lori Amerson
(74) *Attorney, Agent, or Firm*—Michael I Kroll

(57) ABSTRACT

An exercise apparatus for use in performing abdominal exercises. The apparatus includes a back support member having a first side for supporting a back of a user and a headrest having a first side for resting a head of a user thereagainst. A device for supporting a neck and head of the user is positioned between the back support member and the headrest. When a user performs an abdominal exercise, the supporting device supports the headrest thereby preventing neck and cervical strain.

5 Claims, 12 Drawing Sheets

ABDOMINAL EXERCISING SUPPORT APPARATUS

BACKGROUND OF THE INVENTION

1. Field of the Invention

The present invention relates generally to exercise devices and, more specifically, to an exercise support apparatus having a resilient element for supporting a user's neck with a headrest during abdominal exercise. The apparatus includes a spring element for connecting a back cushion to a head rest to provide both cervical and back support. The back cushion has telescopic legs for supporting the apparatus. The spring element is positioned on an extendable rail which extends from a first side of the back cushion. A cradle is connected between the spring element and the head rest for maintaining a desired tension level and fully supporting the head and neck of a user during abdominal exercise. Preferably, the apparatus can be disassembled for easy and convenient storage thereof.

2. Description of the Prior Art

There are other exercise support apparatus designed for support of the body. Typical of these is U.S. Pat. No. 5,441,473 issued to Safani et al. on Aug. 15, 1995.

Another patent was issued to Brown on Feb. 20, 1996 as U.S. Pat. No. 5,492,520. Yet another U.S. Pat. No. 5,545,114 was issued to Gvoich on Aug. 13, 1996 and still yet another was issued on Mar. 10, 1998 to Colonello et al. as U.S. Pat. No. 5,725,463.

Another patent was issued to Sands on Mar. 17, 1998 as U.S. Pat. No. 5,728,035. Yet another U.S. Pat. No. 5,730,688 was issued to Prusick on Mar. 24, 1998. Another was issued to Allis et al. on Sep. 15, 1998 as U.S. Pat. No. 5,807,220 and still yet another was issued on Feb. 16, 1999 to Gvoich as U.S. Pat. No. 5,871,425.

Another patent was issued to Yeh on Mar. 30, 1999 as U.S. Pat. No. 5,888,181. Yet another U.S. Pat. No. 5,931,768 was issued to Amesquita on Aug. 3, 1999. Another was issued to Liu on Jul. 18, 2000 as U.S. Pat. No. 6,090,023 and still yet another was issued on Nov. 6, 2001 to Prusick as U.S. Pat. No. 6,312,366.

While these exercise support devices may be suitable for the purposes for which they were designed, they would not be as suitable for the purposes of the present invention, as hereinafter described. The present invention is an exercise support apparatus having a resilient element for supporting the neck with a headrest whereby tension from a spring provides support thereof. The apparatus is a spring element for cervical and back support that can be disassembled into three parts. The headrest, cervical extension and body table are designed to be adjustable to fit different body sizes.

U.S. Pat. No. 5,441,473

Inventor: Alan K. Safani et al.

Issued: Aug. 15, 1995

An exercising machine for the back, which is simple, compact, economical and suited for home use, includes a base that is constructed to lie flat on the floor. Included in this base is a seat upon which the user sits while leaning back against a pivoting arm. The pivoting arm has a resistance device that provides resistance to backward motion so as to work the muscles of the back. The pivoting arm is shaped to lie down flat when not in use, in a space defined by the base, creating a compact, substantially rectangular unit that is easy to handle and store.

U.S. Pat. No. 5,492,520

Inventor: Donald Brown

Issued: Feb. 20, 1996

The abdominal exerciser device is made of a one piece skeletal frame. The frame defines a pair of support rails, a pair of arcuate rocker portions, a pair of armrest portions and an upstanding arch-shaped portion connecting the support rails together. Removable cushions are disposed on the armrest portions to receive the elbows of the user when in a supine position. The head and neck of a user are supported on a support extending across the arch-shaped portion. The rocker portions are curved on a circular arc to mimic the curvature of the spine of the user.

U.S. Pat. No. 5,545,114

Inventor: Ned Gvoich

Issued: Aug. 13, 1996

An exercise device for exercising all of the major muscles comprising the upper and lower abdomen and back, while avoiding undue stress on the lumbar and cervical spinal discs and the muscles comprising the lower back and hip flexors. The device provides rigid upper and lower back supports which are pivotally joined at a point that restricts flexure of the spine to the T10-L1 region. Resistance means attach to the pivotal portions of the device to allow adjustable resistance to exercise motions. U.S. Pat. No. 5,725,463

Inventor: Dennis J. Colonello et al.

Issued: Mar. 10, 1998

An abdominal exercise device to assist in exercising all three abdominal muscles includes a platform that is placed on a flat supporting surface. A substantially U-shaped body cage is pivotally mounted on the platform and extends outwardly therefrom and includes a U-shaped neck and head support portion and a pair of platform connecting portions adjustable connected thereto. A padded cushion mounted on the support portion supports the head of the user. A pair of pivot members pivotally connect the body cage to the platform. Each pivot member includes a cylindrical portion for pivotally rotatably mounting the body cage to side walls of the platform, and a semispherical portion which connects to free ends of the body cage. A user reclines on the platform and grasps the body cage and performs a sit-up type of motion with the body cage ensuring a full range of motion in the proper plane of movement to maximally recruit the abdominal muscles.

U.S. Pat. No. 5,728,035

Inventor: Leonard I. Sands

Issued: Mar. 17, 1998

Anchor plates for a framework abdominal exercise device provide greater stability, a stable axis of rotation, and a better location for the axis of rotation. A base pad is flanked by two brace supports that have a wide lower portion for distributing forces and a narrower upper portion for engaging the abdominal exercise device. The brace supports are separated by a greater width at their lower portion than at their upper portion. Intermediating the disparity between these separating widths is an intermediate portion that slants inwardly and acts as a shock-absorbing spring to provide better performance by the anchor plate. The base pad of the anchor plate may have an undersurface of a non-skid material to provide greater friction with an underlying floor, thereby preventing slipping and sliding. In alternative embodiments of the present invention, side reinforcing ridges may extend forwardly from the lower forward portions of the brace supports to provide greater support to the brace supports. A rear extension may also provide greater stability. Pivot holes present at the top of the brace supports provide means by which the associated abdominal exercise device may be bolted or otherwise pivotally attached to the anchor plate. The pivot hole is located off-center with respect to the base pad, generally rearwardly rearward of the center of base pad, to provide greater stability and performance.

U.S. Pat. No. 5,730,688

Inventor: Vincent R. Prusick

Issued: Mar. 24, 1998

An exercise device for use in exercising and strengthening abdominal and lower back muscles. The device is easily utilized, may be readily disassembled, and is easily portable. The device utilizes individual upright resilient bars of varying degrees of resistance which may be interchangeably affixed to a seat portion of the device. The upper portion of the resilient bar feature, which may be bowed in one direction, has an attached padded upper body support on one side and a harness element on the other. The user may sit on the seat element and exert backward pressure against the upper back support to exercise lumber (extensor) paraspinal muscles of the lower back, or the user may sit on the seat element with a harness around the user's chest and affixed to the upper end of the resilient bar and bend forwardly exerting pressure away from the bar to exercise the abdominal muscles. A padded lower back support is provided to assist in properly positioning the user on the device.

U.S. Pat. No. 5,807,220

Inventor: Robert A. Allis et al.

Issued: Sep. 15, 1998

An exercise device for use in exercising the abdominal muscles by performing sit-ups, which device protects the neck and upper back while the user performs such exercises.

U.S. Pat. No. 5,871,425

Inventor: Ned Gvoich

Issued: Feb. 16, 1999

An exercise device for exercising all of the major muscles comprising the upper and lower abdomen and back, while avoiding undue stress on the lumbar and cervical spinal discs and the muscles comprising the lower back and hip flexors. The device provides rigid upper and lower back supports which are pivotally joined at a point which restricts flexure of the spine to the T10-L1 region. Resistance means attach to the pivotal portions of the device to allow adjustable resistance to exercise motions.

U.S. Pat. No. 5,888,181

Inventor: Hsiu Ying Yeh

Issued: Mar. 30, 1999

An auxiliary supporting device generally comprises a head pad section, a backrest, section, a hip section and a joint set. The insert of the head pad section can be inserted into the receiving hole of the backrest section such that the projected section of the head pad section is biased against to the front section of the backrest section. The moveable latch of the backrest section can be inserted into the moveable latch hole of the rolling rod. And then a pair of positioning latches can be inserted into the positioning latch holes such that the relative position between the supporting arm of the bottom bracket and the rolling rod can be attained. The clamp of the retaining block of the hip pad section can be engaged with the retaining beam of the backrest section. By this arrangement, a foldable auxiliary sporting device is attained.

U.S. Pat. No. 5,931,768

Inventor: Robert Amesquita

Issued: Aug. 3, 1999

An abdominal exercise apparatus has an elongated rigid member for positioning between a user's back and a support surface for executing a crunch. A grasping mechanism, such as a strap member, is attached to the rigid member to allow the user to lift the head end of the rigid member from the support surface by contracting the abdominal muscles. A pivot member is connected to the rigid member adjacent the user's lower back and positioned to engage the support surface. A weight retaining mechanism, such as a post, adapted to receive weighted plates, may be attached to the rigid member to enhance the workout to the abdominal and lower back muscles.

U.S. Pat. No. 6,090,023

Inventor: Chao-Jih Liu

Issued: Jul. 18, 2000

A body exerciser includes a base frame with two support rods provided with first coupling members, and a handle frame with two bendable handle rods provided with second coupling members that are rotatable relative to the first coupling members. Each of two retaining sets is disposed between inner engaging walls of the first and second coupling members to arrest relative rotation in a tightened state. Only in a loosened state when the inner engaging walls have been brought away from each other will relative rotation between the first and second coupling members be permitted. Each of two biasing members is disposed between the inner engaging walls to bias the second coupling members to move away from the first coupling members. Each of two tightening rods is inserted into the coupling members, and has a pivot end extending outwardly of the respective second coupling member. A locking member is pivoted on the pivot end and has first and second cam surfaces. When in the loosened state, the first cam surface faces the respective second coupling member. By turning the locking member to bring the second cam surface to move against the biasing action of the respective biasing member, the respective second coupling member can be urged to engage the respective first coupling member.

U.S. Pat. No. 6,312,366

Inventor: Vincent R. Prusick

Issued: Nov. 6, 2001

An exercise device for use in exercising and strengthening abdominal and lower back muscles. The device is easily utilized, may be readily disassembled, and is easily portable. The device utilizes individual upright resilient bars of varying degrees of resistance which may be interchangeably affixed to a seat portion of the device. The upper portion of the resilient bar feature, which may be bowed in one direction, has an attached padded upper body support on one side and a harness element on the other. The user may sit on the seat element and exert back-ward pressure against the upper back support to exercise lumber (extensor) paraspinal muscles of the lower back, or the user may sit on the seat element gripping a handlebar assembly affixed to the upper end of the resilient bar and bend forwardly exerting pressure away from the bar to exercise the abdominal muscles. A padded lower back support is provided to assist in properly positioning the user on the device.

SUMMARY OF THE PRESENT INVENTION

The present invention relates generally to exercise devices and, more specifically, to an exercise support apparatus having a resilient element for supporting a user's neck with a headrest during abdominal exercise. The apparatus includes a spring element for connecting a back cushion to a head rest to provide both cervical and back support. The back cushion has telescopic legs for supporting the apparatus. The spring element is positioned on an extendable rail which extends from a first side of the back cushion. A cradle is connected between the spring element and the head rest for maintaining a desired tension level and fully supporting the head and neck of a user during abdominal exercise. Preferably, the apparatus can be disassembled for easy and convenient storage thereof.

A primary object of the present invention is to provide an exercise support apparatus that overcomes the shortcomings of the prior art.

Another, secondary object of the present invention is to provide an exercise support apparatus having a resilient element connected between a back cushion and a headrest for supporting a user's neck with the headrest.

Another object of the present invention is to provide an exercise support apparatus wherein the resilient element is formed from a moveable cradle connected to a spring.

A further object of the present invention is to provide an exercise support apparatus whereby the tension of the spring supports the headrest connected thereto.

Yet another object of the present invention is to provide an exercise support apparatus wherein the moveable cradle causes the headrest to move along with the user when performing an abdominal exercise.

Another object of the present invention is to provide an exercise support apparatus wherein the back cushion, headrest, and resilient element are selectively adjustable to fit different body sizes.

Another object of the present invention is to provide an exercise support apparatus that the spring extension is covered with plastic coverings, corrugated or non corrugated to aid in comfort and assist in design aesthetics and protection.

Yet another object of the present invention is to provide an exercise support apparatus wherein the resilient element is connected to a selectively extendable rail received within a guide positioned on an underside of the back cushion.

Still another object of the present invention is to provide an exercise support apparatus wherein the resilient element is also connected to the headrest via a second rail.

A further object of the present invention is to provide an exercise support apparatus wherein the headrest is selectively moveable along the length of the second rail for adjustment thereof.

Still a further object of the present invention is to provide an exercise support apparatus wherein that the headrest and back cushion are adjusted by a spring loaded adjuster bar for selectively locking each of the headrest and back cushion in place along their respective rails.

Still yet another object of the present invention is to provide an exercise support apparatus that includes handles within the back cushion for providing improved stabilization and support.

Another object of the present invention is to provide an exercise support apparatus that is simple and easy to use.

Still yet another object of the present invention is to provide an exercise support apparatus that is inexpensive to manufacture and use.

Additional objects of the present invention will appear as the description proceeds.

The present invention overcomes the shortcomings of the prior art by providing an exercise support apparatus having a resilient element for supporting a user's neck with a headrest during abdominal exercise. The apparatus includes a spring element for connecting a back cushion to a head rest to provide both cervical and back support. The back cushion has telescopic legs for supporting the apparatus. The spring element is positioned on an extendable rail which extends from a first side of the back cushion. A cradle is connected between the spring element and the head rest for maintaining a desired tension level and fully supporting the head and neck of a user during abdominal exercise. Preferably, the apparatus can be disassembled for easy and convenient storage thereof.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
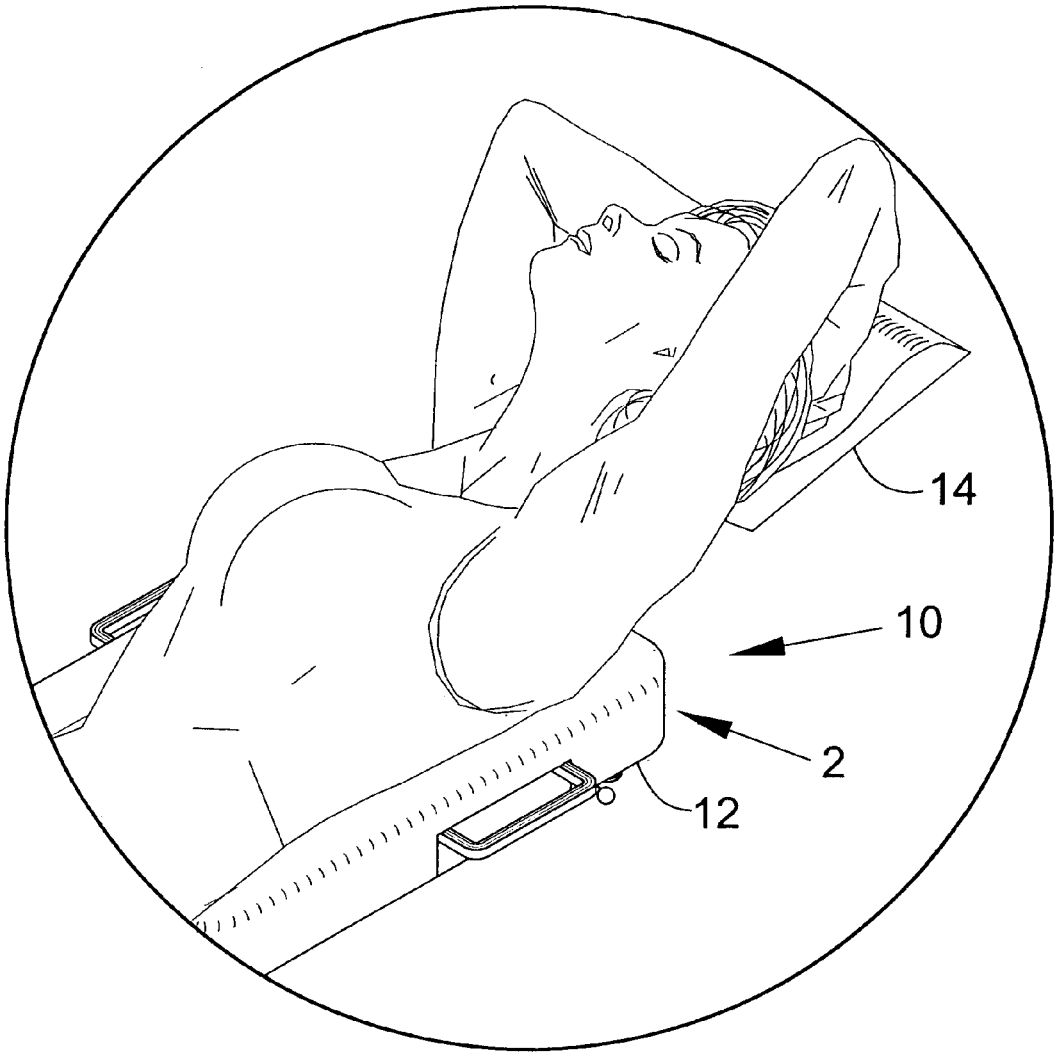
FIG. 1 is an illustrative view of the exercise apparatus of the present invention in use.

Turning now descriptively to the drawings, in which similar reference characters denote similar elements throughout the several views, the Figures illustrate the exercise apparatus of the present invention. With regard to the reference numerals used, the following numbering is used throughout the various drawing Figures.

| | |
|---|---|
| 10 | exercise apparatus of the present invention |
| 12 | back cushion |
| 14 | headrest |
| 15 | securing aperture |
| 16 | cradle |
| 17 | securing pin |
| 18 | tension spring |
| 20 | first adjustment knob |
| 21 | first locking pin |
| 22 | support legs |
| 24 | handle |
| 26 | tension adjustment knob |
| 28 | first extension rail |
| 30 | guide |
| 32 | first locking apertures |
| 33 | securing aperture |
| 34 | second extension rail |
| 36 | second locking apertures |
| 38 | second adjustment knob |
| 39 | second locking pin |
| 40 | locking bracket |

DETAILED DESCRIPTION OF THE PREFERRED EMBODIMENT

The following discussion describes in detail one embodiment of the invention and several variations of that embodiment. This discussion should not be construed, however, as limiting the invention to those particular embodiments. Practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 12 illustrate an exercise apparatus of the present invention indicated generally by the numeral 10.

FIG. 1 is an illustrative view of the exercise apparatus of the present invention in use. The present invention is an improvement on abdominal exercise equipment by providing cervical and back support during an exercise regimen. The apparatus 10 includes a back cushion 12 connected to a headrest 14 via a cradle 16 and a tension spring 18 as shown hereinafter with specific reference to FIGS. 2–8. The tension created by the tension spring 18 causes the cradle 16 and head rest to remain in a locked position. Therefore, as shown in FIG. 1, a back of a user is positioned adjacent to and on top of the back cushion 12 and a head of the user is position on the headrest 14. When a user performs an abdominal exercise, such as a sit-up, the cradle 16 causes the headrest 14 to move with the user and continue to support the head and neck of the user during the duration of the exercise. Furthermore, when the user moves back to a relaxed position, the tension spring 18 absorbs the pressure and causes the cradle 16 to be moved towards the surface on which the apparatus 10 is positioned.

Figure 2:
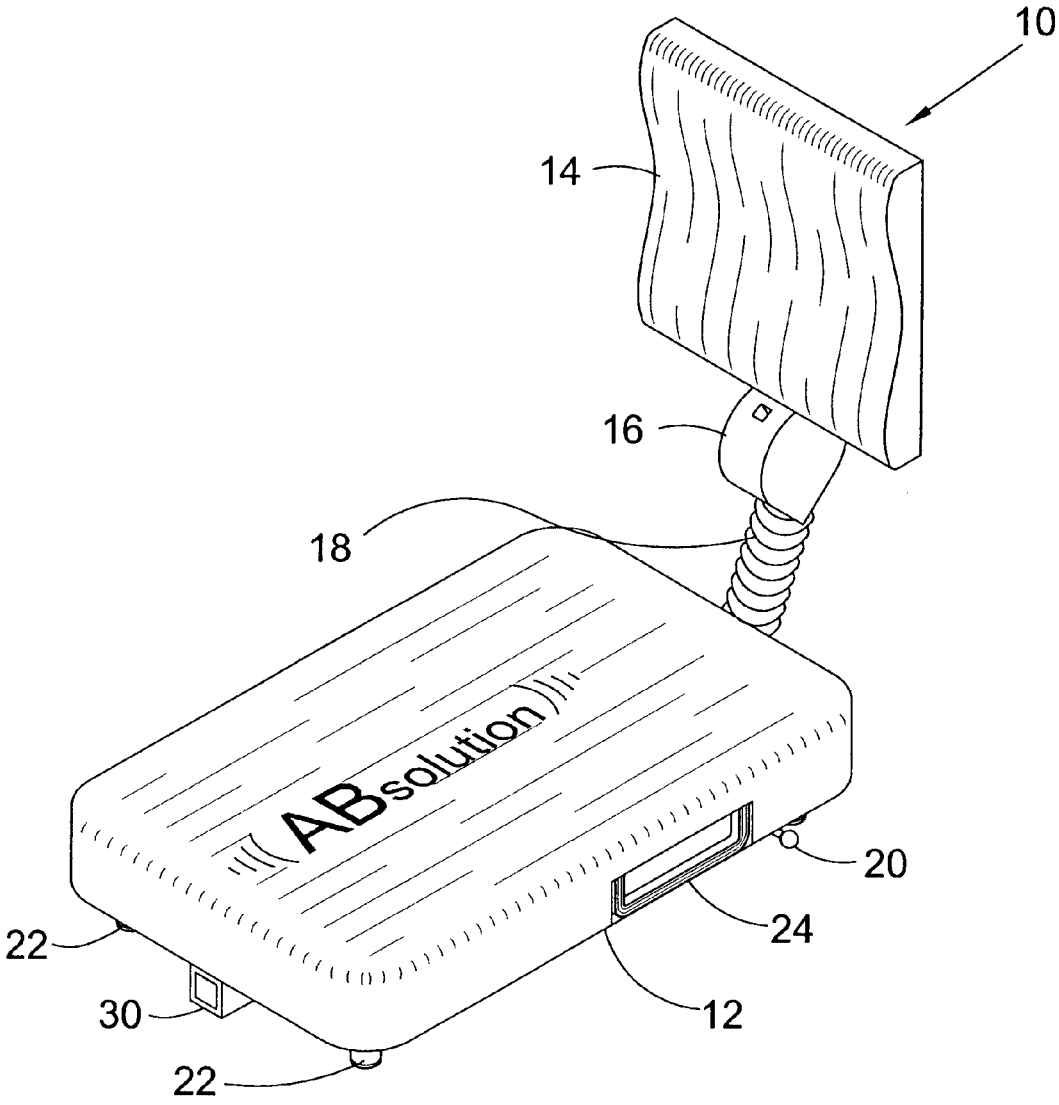
FIG. 2 is a perspective view of the exercise apparatus of the present invention.

FIG. 2 is a perspective view of the exercise apparatus of the present invention. The apparatus 10 includes the back cushion 12 and the headrest 14 connected via the tension spring 18 and the cradle 16. The tension spring 18 is connected to a first extension rail 28 as shown in FIGS. 4–12. The first extension rail 28 is received within the guide track 30 and the first extension rail 28 includes first locking apertures 32 extending therealong. The first extension rail 28 extends outward from a first end of the back cushion 12 and is locked in place by the first adjustment knob 20. The first adjustment knob 20 is connected to the first locking pin 21 as shown in FIG. 11. The first extension rail 28 is moved within the guide track 30 in order to extend the headrest 14 from the first end of the back cushion 12. Upon positioning the headrest 14 at a desired distance from the back cushion 12, the first adjustment knob causes the first locking pin 21 to be received within a respective first locking aperture 32. The first adjustment knob 20 is spring loaded and therefore can be pulled in a direction opposite the apparatus and the first locking pin 21 will be removed from the respective aperture 32. By sliding the first extension rail along the length of the guide track 30, the spring loaded first adjustment knob causes the guide pin 21 to be received within another locking aperture 32. Additionally, the apparatus 10 further includes at least four support legs 22. Each support leg 22 extends telescopically so as to provide support for the apparatus 10. Also, the apparatus includes at least one handle 24 positioned on a side of the back cushion 12. The at least one handle 24 allows the user to grip the apparatus 10 to provide stability when performing the abdominal exercises.

Figure 3:
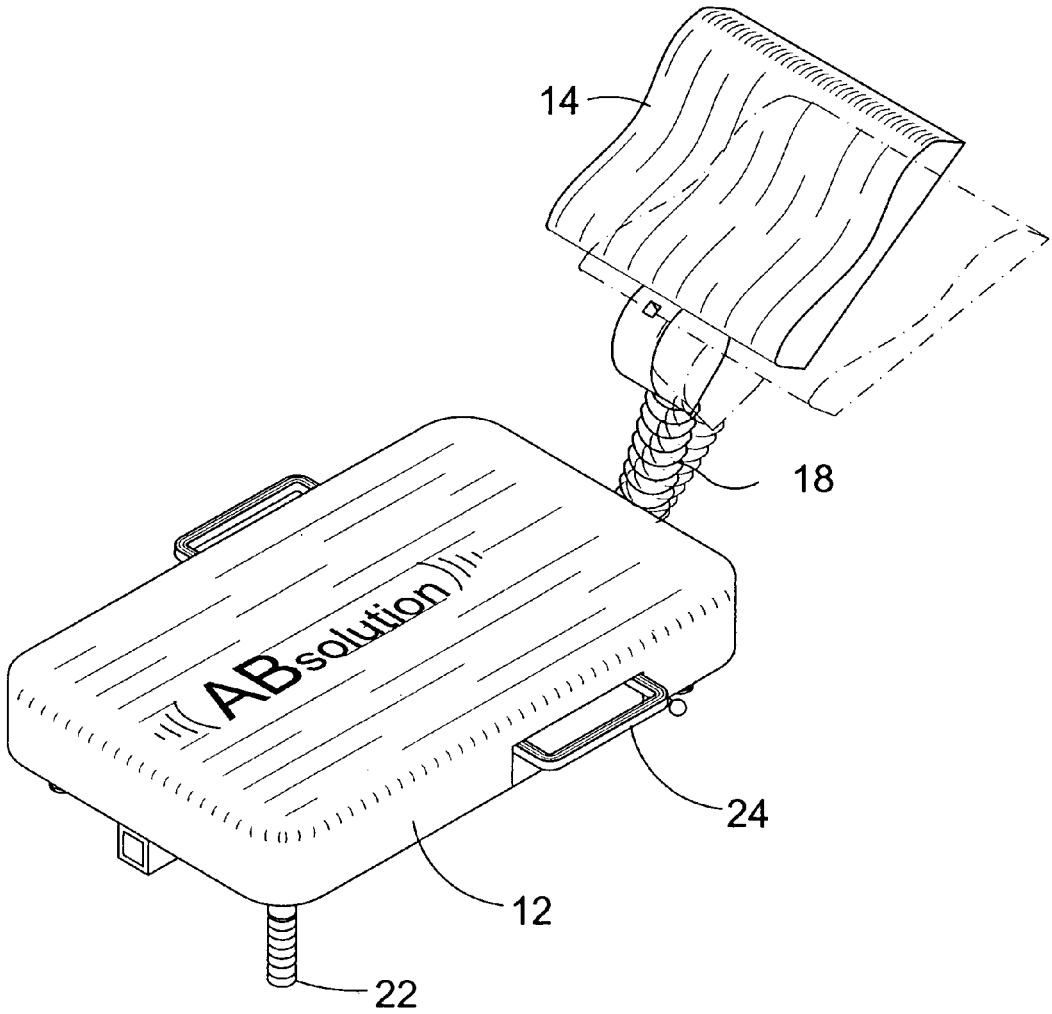
FIG. 3 is a perspective view of the exercise apparatus of the present invention showing the moveable headrest.

FIG. 3 is a perspective view of the exercise apparatus of the present invention showing the moveable headrest. The apparatus 10 includes the back cushion 12 and the headrest 14 connected via the tension spring 18 and the cradle 16. The tension spring 18 is connected to the first extension rail 28 as shown in FIGS. 4–12. The first extension rail 28 is received within the guide track 30 and the first extension rail 28 includes the first locking apertures 32 extending therealong. The first extension rail 28 extends outward from the first end of the back cushion 12 and is locked in place by the first adjustment knob 20. The first adjustment knob 20 is connected to the first locking pin 21 as shown in FIG. 11. The first extension rail 28 is moved within the guide track 30 in order to extend the headrest 14 from the first end of the back cushion 12. Upon positioning the headrest 14 at a desired distance from the back cushion 12, the first adjustment knob causes the first locking pin 21 to be received within a respective first locking aperture 32. The first adjustment knob 20 is spring loaded and therefore can be pulled in a direction opposite the apparatus and the first locking pin 21 will be removed from the respective aperture 32. By sliding the first extension rail along the length of the guide track 30, the spring loaded first adjustment knob causes the guide pin 21 to be received within another locking aperture 32. Additionally, the apparatus 10 further includes at least four support legs 22. Each support leg 22 extends telescopically so as to provide support for the apparatus 10. Also, the apparatus includes at least one handle 24 positioned on a side of the back cushion 12. The at least one handle 24 allows the user to grip the apparatus 10 to provide stability when performing the abdominal exercises.

The headrest 14 is moveable upon receiving the weight of a user's head and neck. The tension spring 18 causes the headrest 14 to move in a direction towards the surface on which the apparatus 10 is resting. When the user performs an abdominal exercise using the apparatus, the abdominal muscles lift the upper body off of the surface. The tension spring 18 and the cradle 16 then provide support for the user's head and neck during the exercise. The device has various control elements which will be discussed hereinafter with specific reference to FIGS. 4–12 whereby a user can selectively adjust elements of the device for personal comfort including the height of the back support and the displacement between the head and back support.

Figure 4:
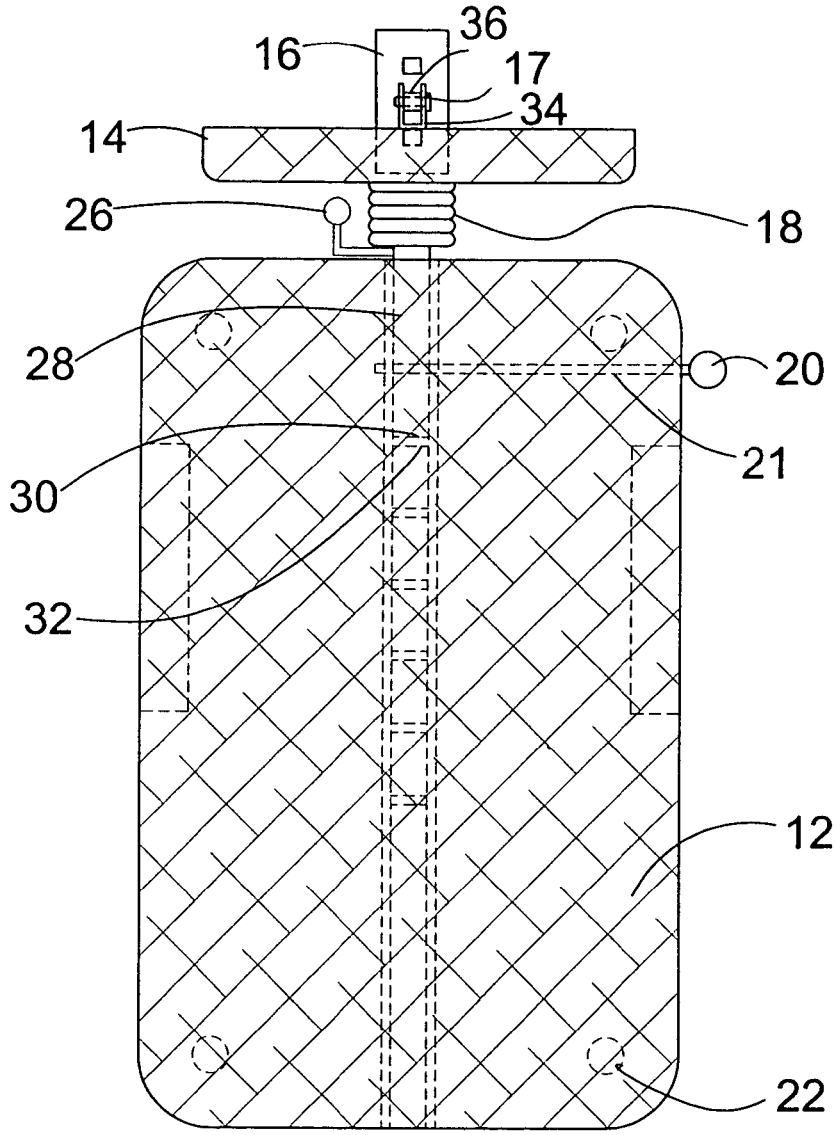
FIG. 4 is a top view of the exercise apparatus of the present invention.

FIG. 4 is a top view of the exercise apparatus of the present invention. The apparatus 10 includes the back cushion 12 and the headrest 14 connected via the tension spring 18 and the cradle 16. The tension spring 18 is connected to the first extension rail 28 as shown in FIGS. 4–12. FIG. 4 shows the underside of the apparatus in dotted lines. The first extension rail 28 is received within the guide track 30 and the first extension rail 28 includes the first locking apertures 32 extending therealong. The first extension rail 28 extends outward from the first end of the back cushion 12 and is locked in place by the first adjustment knob 20. The first adjustment knob 20 is connected to the first locking pin 21 as shown in FIG. 11. The first extension rail 28 is moved within the guide track 30 in order to extend the headrest 14 from the first end of the back cushion 12. Upon positioning the headrest 14 at a desired distance from the back cushion 12, the first adjustment knob causes the first locking pin 21 to be received within a respective first locking aperture 32. The first adjustment knob 20 is spring loaded and therefore can be pulled in a direction opposite the apparatus and the first locking pin 21 will be removed from the respective aperture 32. By sliding the first extension rail along the length of the guide track 30, the spring loaded first adjustment knob causes the guide pin 21 to be received within another locking aperture 32.

A tension adjustment knob 26 is connected to the tension spring 18 and the first extension rail 28. The tension adjustment knob 26 allows a user to selectively adjust the amount of tension retained by the tension spring 18. This allows different user's having different body weights the ability to use the apparatus 10. The greater the tension of the spring 18 the stiff the position in which the headrest 14 is maintained thus providing greater support for heavier users.

The headrest 14 is connected to the cradle 16 by a second extension rail 34 which is secured thereto by a securing pin 17. The securing pin 17 passes through a securing aperture 15 of the cradle 16 and a securing aperture 33 of the second extension rail 34. The second extension rail 34 can be selectively positioned in three positions as will be shown in FIGS. 5–7 and then secured by the securing pin 17. The movement of the headrest 14 will be discussed hereinafter with specific reference to FIGS. 5–8.

Additionally, the apparatus 10 further includes at least four support legs 22. Each support leg 22 extends telescopically so as to provide support for the apparatus 10. Also, the apparatus includes at least one handle 24 positioned on a side of the back cushion 12. The at least one handle 24 allows the user to grip the apparatus 10 to provide stability when performing the abdominal exercises.

Figure 5:
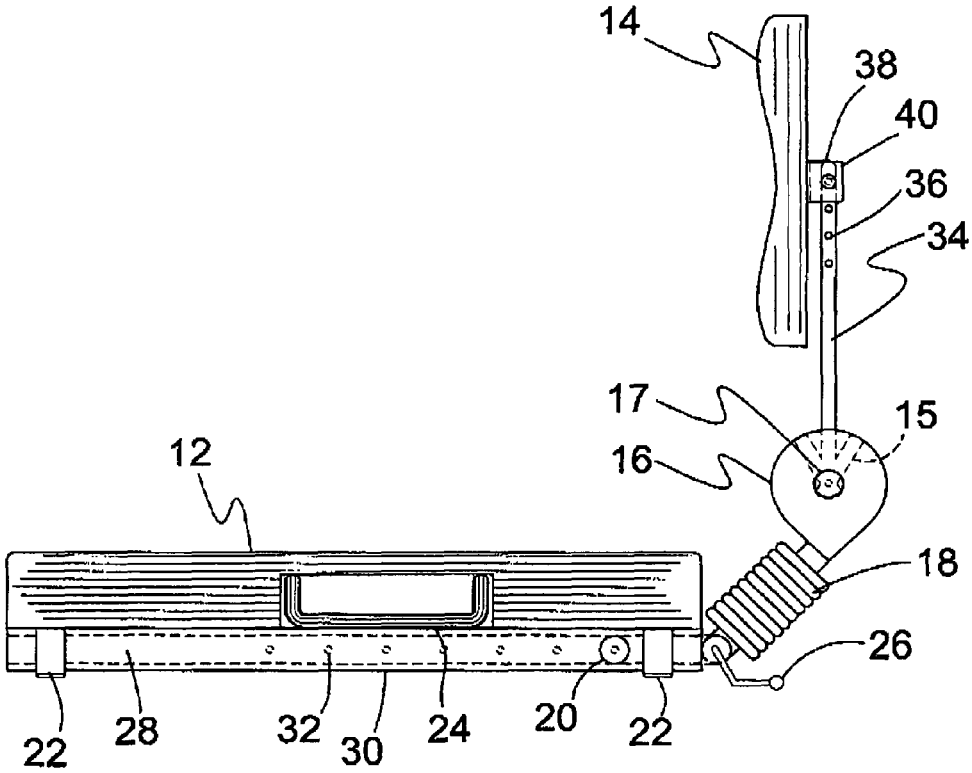
FIG. 5 is a side view of the exercise apparatus of the present invention showing the headrest locked in a first position.

FIG. 5 is a side view of the exercise apparatus of the present invention showing the headrest locked in a first position. The apparatus 10 includes the back cushion 12 and the headrest 14 connected via the tension spring 18 and the cradle 16. The tension spring 18 is connected to the first extension rail 28 as shown in FIGS. 4–12. FIG. 4 shows the underside of the apparatus in dotted lines. The first extension rail 28 is received within the guide track 30 and the first extension rail 28 includes the first locking apertures 32 extending therealong. The first extension rail 28 extends outward from the first end of the back cushion 12 and is locked in place by the first adjustment knob 20. The first adjustment knob 20 is connected to the first locking pin 21 as shown in FIG. 11. The first extension rail 28 is moved within the guide track 30 in order to extend the headrest 14 from the first end of the back cushion 12. Upon positioning the headrest 14 at a desired distance from the back cushion 12, the first adjustment knob causes the first locking pin 21 to be received within a respective first locking aperture 32. The first adjustment knob 20 is spring loaded and therefore can be pulled in a direction opposite the apparatus and the first locking pin 21 will be removed from the respective aperture 32. By sliding the first extension rail along the length of the guide track 30, the spring loaded first adjustment knob causes the guide pin 21 to be received within another locking aperture 32.

A tension adjustment knob 26 is connected to the tension spring 18 and the first extension rail 28. The tension adjustment knob 26 allows a user to selectively adjust the amount of tension retained by the tension spring 18. This allows different user's having different body weights the ability to use the apparatus 10. The greater the tension of the spring 18 the stiff the position in which the headrest 14 is maintained thus providing greater support for heavier users.

The headrest 14 is connected to the cradle 16 by a second extension rail 34 which is secured thereto by a securing pin 17. The securing pin 17 passes through a securing aperture 15 of the cradle 16 and a securing aperture 33 of the second extension rail 34. The second extension rail 34 further includes a plurality of second locking apertures extending therethrough and along a length thereof. FIG. 5 shows the second extension rail 34 secured in a central position to the cradle 16 by the securing pin 17. The headrest 14 has a connection bracket 40 positioned on a side of the headrest that does not contact a head of the user. The connection bracket 40 is slidably connected to the second extension rail 34 via a second locking pin 38. The user selectively slides the headrest 14 along the length of the second extension rail 34 and upon reaching a desired position, the second locking pin 38 is inserted through a hole in the connection bracket which corresponds to a respective second locking aperture 36 of the second extension rail 34. Preferably, the second locking pin 38 is a spring loaded locking pin similar in design and operation to the first locking pin 21 described above.

Additionally, the apparatus 10 further includes at least four support legs 22. Each support leg 22 extends telescopically so as to provide support for the apparatus 10. Also, the apparatus includes at least one handle 24 positioned on a side of the back cushion 12. The at least one handle 24 allows the user to grip the apparatus 10 to provide stability when performing the abdominal exercises.

Figure 6:
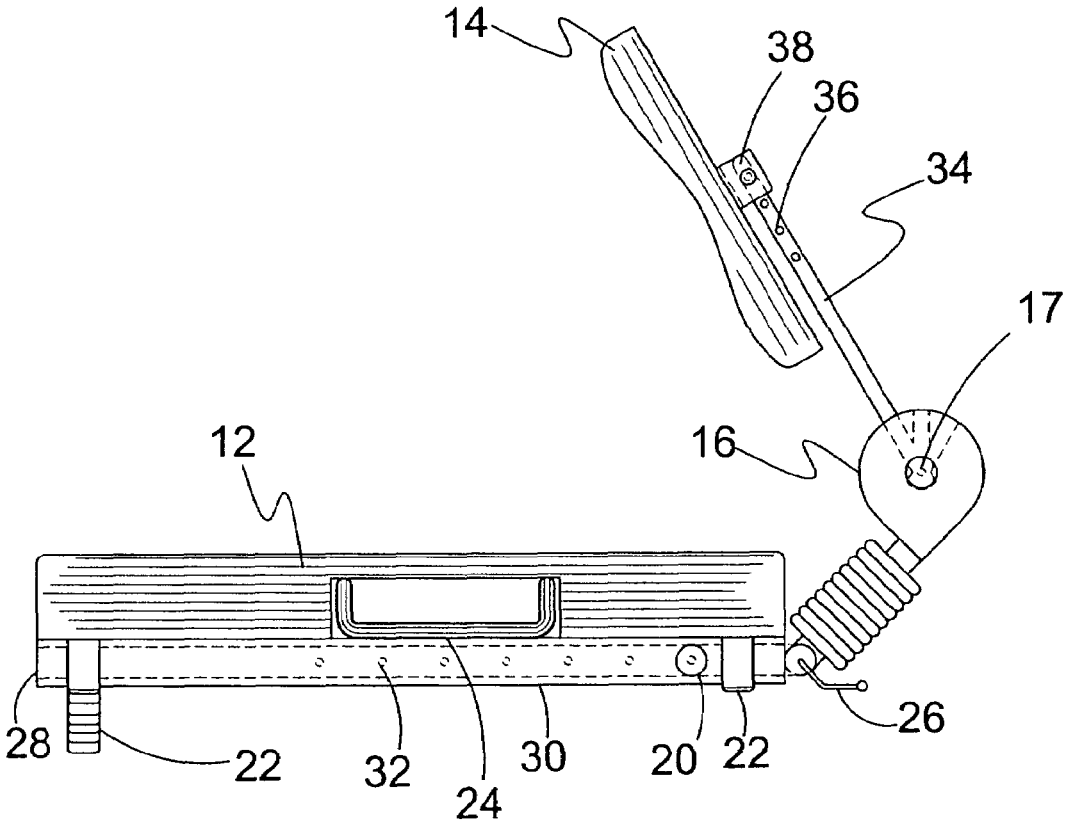
FIG. 6 is a side view of the exercise apparatus of the present invention showing the headrest locked in a second position.

FIG. 6 is a side view of the exercise apparatus of the present invention showing the headrest locked in a second position. The apparatus 10 includes the back cushion 12 and the headrest 14 connected via the tension spring 18 and the cradle 16. The tension spring 18 is connected to the first extension rail 28 as shown in FIGS. 4–12. FIG. 4 shows the underside of the apparatus in dotted lines. The first extension rail 28 is received within the guide track 30 and the first extension rail 28 includes the first locking apertures 32 extending therealong. The first extension rail 28 extends outward from the first end of the back cushion 12 and is locked in place by the first adjustment knob 20. The first adjustment knob 20 is connected to the first locking pin 21 as shown in FIG. 11. The first extension rail 28 is moved within the guide track 30 in order to extend the headrest 14 from the first end of the back cushion 12. Upon positioning the headrest 14 at a desired distance from the back cushion 12, the first adjustment knob causes the first locking pin 21 to be received within a respective first locking aperture 32. The first adjustment knob 20 is spring loaded and therefore can be pulled in a direction opposite the apparatus and the first locking pin 21 will be removed from the respective aperture 32. By sliding the first extension rail along the length of the guide track 30, the spring loaded first adjustment knob causes the guide pin 21 to be received within another locking aperture 32.

A tension adjustment knob 26 is connected to the tension spring 18 and the first extension rail 28. The tension adjustment knob 26 allows a user to selectively adjust the amount of tension retained by the tension spring 18. This allows different user's having different body weights the ability to use the apparatus 10. The greater the tension of the spring 18 the stiff the position in which the headrest 14 is maintained thus providing greater support for heavier users.

The headrest 14 is connected to the cradle 16 by a second extension rail 34 which is secured thereto by a securing pin 17. The securing pin 17 passes through a securing aperture 15 of the cradle 16 and a securing aperture 33 of the second extension rail 34. The second extension rail 34 further includes a plurality of second locking apertures extending therethrough and along a length thereof. FIG. 6 shows the second extension rail 34 secured in a forward position to the cradle 16 by the securing pin 17 thereby causing the users head to be positioned closer to their abdomen. The headrest 14 has the connection bracket 40 positioned on the side of the headrest that does not contact a head of the user. The connection bracket 40 is slidably connected to the second extension rail 34 via the second locking pin 38. The user selectively slides the headrest 14 along the length of the second extension rail 34 and upon reaching a desired position, the second locking pin 38 is inserted through a hole in the connection bracket 40 which corresponds to a respective second locking aperture 36 of the second extension rail 34. Preferably, the second locking pin 38 is a spring loaded locking pin similar in design and operation to the first locking pin 21 described above.

Additionally, the apparatus 10 further includes at least four support legs 22. Each support leg 22 extends telescopically so as to provide support for the apparatus 10. Also, the apparatus includes at least one handle 24 positioned on a side of the back cushion 12. The at least one handle 24 allows the user to grip the apparatus 10 to provide stability when performing the abdominal exercises.

Figure 7:
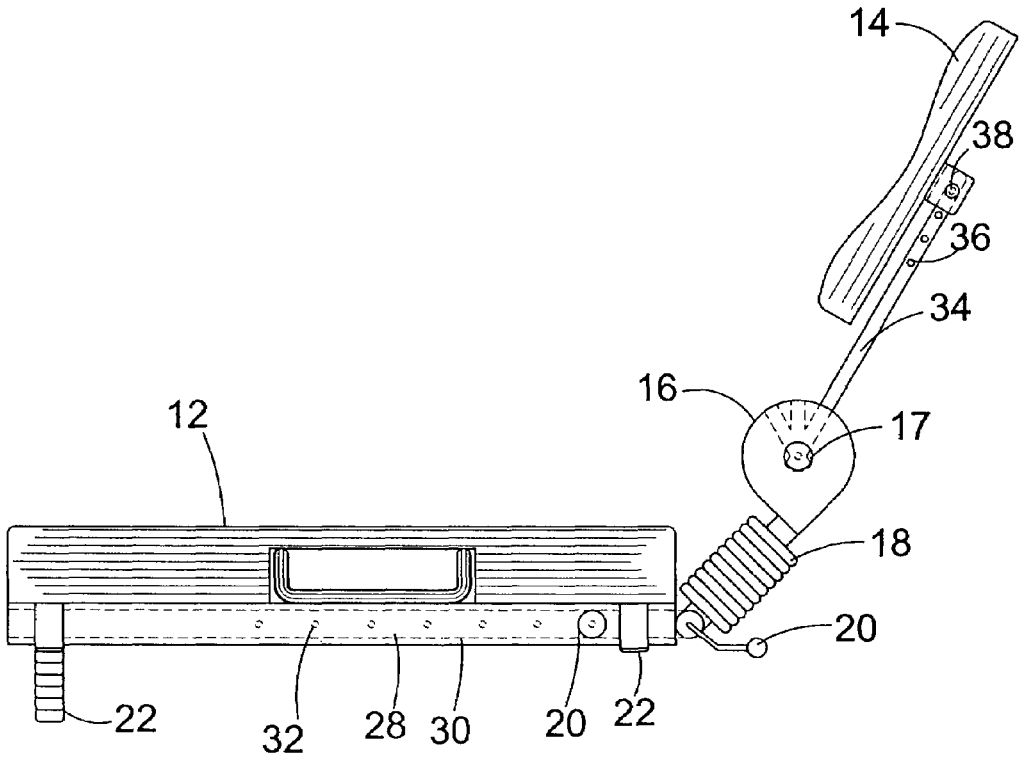
FIG. 7 is a side view of the exercise apparatus of the present invention showing the headrest locked in a third position.

FIG. 7 is a side view of the exercise apparatus of the present invention showing the headrest locked in a third position. The apparatus 10 includes the back cushion 12 and the headrest 14 connected via the tension spring 18 and the cradle 16. The tension spring 18 is connected to the first extension rail 28 as shown in FIGS. 4–12. FIG. 4 shows the underside of the apparatus in dotted lines. The first extension rail 28 is received within the guide track 30 and the first extension rail 28 includes the first locking apertures 32 extending therealong. The first extension rail 28 extends outward from the first end of the back cushion 12 and is locked in place by the first adjustment knob 20. The first adjustment knob 20 is connected to the first locking pin 21 as shown in FIG. 11. The first extension rail 28 is moved within the guide track 30 in order to extend the headrest 14 from the first end of the back cushion 12. Upon positioning the headrest 14 at a desired distance from the back cushion 12, the first adjustment knob causes the first locking pin 21 to be received within a respective first locking aperture 32. The first adjustment knob 20 is spring loaded and therefore can be pulled in a direction opposite the apparatus and the first locking pin 21 will be removed from the respective aperture 32. By sliding the first extension rail along the length of the guide track 30, the spring loaded first adjustment knob causes the guide pin 21 to be received within another locking aperture 32.

A tension adjustment knob 26 is connected to the tension spring 18 and the first extension rail 28. The tension adjustment knob 26 allows a user to selectively adjust the amount of tension retained by the tension spring 18. This allows different user's having different body weights the ability to use the apparatus 10. The greater the tension of the spring 18 the stiff the position in which the headrest 14 is maintained thus providing greater support for heavier users.

The headrest 14 is connected to the cradle 16 by a second extension rail 34 which is secured thereto by a securing pin 17. The securing pin 17 passes through a securing aperture 15 of the cradle 16 and a securing aperture 33 of the second extension rail 34. The second extension rail 34 further includes a plurality of second locking apertures extending therethrough and along a length thereof. FIG. 7 shows the second extension rail 34 secured in a back position to the cradle 16 by the securing pin 17 thereby causing the users head to be positioned further from their abdomen thus allowing the user to exercise in a near-prone position. The headrest 14 has the connection bracket 40 positioned on the side of the headrest that does not contact a head of the user. The connection bracket 40 is slidably connected to the second extension rail 34 via the second locking pin 38. The user selectively slides the headrest 14 along the length of the second extension rail 34 and upon reaching a desired position, the second locking pin 38 is inserted through a hole in the connection bracket 40 which corresponds to a respective second locking aperture 36 of the second extension rail 34. Preferably, the second locking pin 38 is a spring loaded locking pin similar in design and operation to the first locking pin 21 described above.

Additionally, the apparatus 10 further includes at least four support legs 22. Each support leg 22 extends telescopically so as to provide support for the apparatus 10. Also, the apparatus includes at least one handle 24 positioned on a side of the back cushion 12. The at least one handle 24 allows the user to grip the apparatus 10 to provide stability when performing the abdominal exercises.

Figure 8:
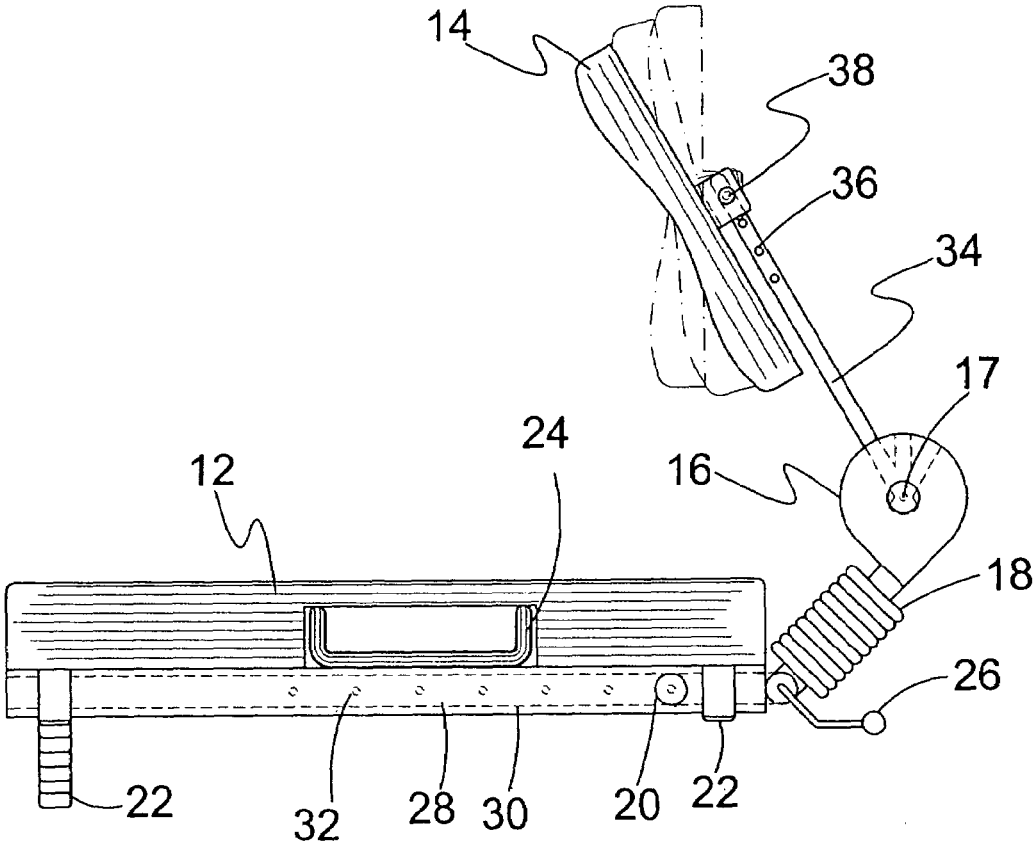
FIG. 8 is a side view of the exercise apparatus of the present invention showing the headrest being pivotable about a locking pin.

FIG. 8 is a side view of the exercise apparatus of the present invention showing the headrest being pivotable about a locking pin. The apparatus 10 includes the back cushion 12 and the headrest 14 connected via the tension spring 18 and the cradle 16. The tension spring 18 is connected to the first extension rail 28 as shown in FIGS. 4–12. FIG. 4 shows the underside of the apparatus in dotted lines. The first extension rail 28 is received within the guide track 30 and the first extension rail 28 includes the first locking apertures 32 extending therealong. The first extension rail 28 extends outward from the first end of the back cushion 12 and is locked in place by the first adjustment knob 20. The first adjustment knob 20 is connected to the first locking pin 21 as shown in FIG. 11. The first extension rail 28 is moved within the guide track 30 in order to extend the headrest 14 from the first end of the back cushion 12. Upon positioning the headrest 14 at a desired distance from the back cushion 12, the first adjustment knob causes the first locking pin 21 to be received within a respective first locking aperture 32. The first adjustment knob 20 is spring loaded and therefore can be pulled in a direction opposite the apparatus and the first locking pin 21 will be removed from the respective aperture 32. By sliding the first extension rail along the length of the guide track 30, the spring loaded first adjustment knob causes the guide pin 21 to be received within another locking aperture 32.

A tension adjustment knob 26 is connected to the tension spring 18 and the first extension rail 28. The tension adjustment knob 26 allows a user to selectively adjust the amount of tension retained by the tension spring 18. This allows different user's having different body weights the ability to use the apparatus 10. The greater the tension of the spring 18 the stiff the position in which the headrest 14 is maintained thus providing greater support for heavier users.

The headrest 14 is connected to the cradle 16 by a second extension rail 34 which is secured thereto by a securing pin 17. The securing pin 17 passes through a securing aperture 15 of the cradle 16 and a securing aperture 33 of the second extension rail 34. The second extension rail 34 further includes a plurality of second locking apertures extending therethrough and along a length thereof. FIG. 8 shows the second extension rail 34 secured in a forward position to the cradle 16 by the securing pin 17 thereby causing the users head to be positioned closer to their abdomen. The headrest 14 has the connection bracket 40 positioned on the side of the headrest that does not contact a head of the user. The connection bracket 40 is slidably connected to the second extension rail 34 via the second locking pin 38. The user selectively slides the headrest 14 along the length of the second extension rail 34 and upon reaching a desired position, the second locking pin 38 is inserted through a hole in the connection bracket 40 which corresponds to a respective second locking aperture 36 of the second extension rail 34. Preferably, the second locking pin 38 is a spring loaded locking pin similar in design and operation to the first locking pin 21 described above. Also, prior to securing the headrest 14 in position with the second locking pin 38, the connection bracket 14 allows the headrest 14 to be selectively pivotable about the axis of the second locking pin 38. This allows the user to selectively determine the most comfortable position for performing any abdominal exercises.

Additionally, the apparatus 10 further includes at least four support legs 22. Each support leg 22 extends telescopically so as to provide support for the apparatus 10. Also, the apparatus includes at least one handle 24 positioned on a side of the back cushion 12. The at least one handle 24 allows the user to grip the apparatus 10 to provide stability when performing the abdominal exercises.

Figure 9:
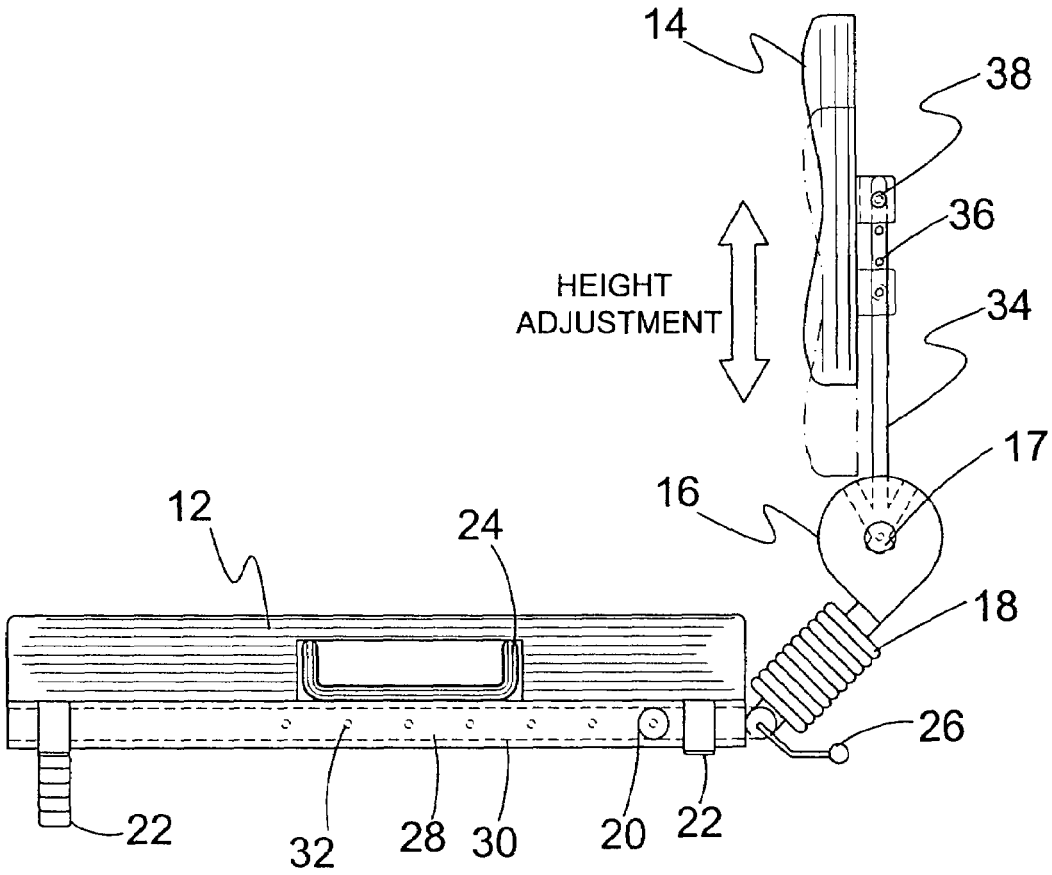
FIG. 9 is a side view of the exercise apparatus of the present invention showing the headrest being moveable along the length of a second rail.

FIG. 9 is a side view of the exercise apparatus of the present invention showing the headrest being moveable along the length of a second rail. The apparatus 10 includes the back cushion 12 and the headrest 14 connected via the tension spring 18 and the cradle 16. The tension spring 18 is connected to the first extension rail 28 as shown in FIGS. 4–12. FIG. 4 shows the underside of the apparatus in dotted lines. The first extension rail 28 is received within the guide track 30 and the first extension rail 28 includes the first locking apertures 32 extending therealong. The first extension rail 28 extends outward from the first end of the back cushion 12 and is locked in place by the first adjustment knob 20. The first adjustment knob 20 is connected to the first locking pin 21 as shown in FIG. 11. The first extension rail 28 is moved within the guide track 30 in order to extend the headrest 14 from the first end of the back cushion 12. Upon positioning the headrest 14 at a desired distance from the back cushion 12, the first adjustment knob causes the first locking pin 21 to be received within a respective first locking aperture 32. The first adjustment knob 20 is spring loaded and therefore can be pulled in a direction opposite the apparatus and the first locking pin 21 will be removed from the respective aperture 32. By sliding the first extension rail along the length of the guide track 30, the spring loaded first adjustment knob causes the guide pin 21 to be received within another locking aperture 32.

A tension adjustment knob 26 is connected to the tension spring 18 and the first extension rail 28. The tension adjustment knob 26 allows a user to selectively adjust the amount of tension retained by the tension spring 18. This allows different user's having different body weights the ability to use the apparatus 10. The greater the tension of the spring 18 the stiff the position in which the headrest 14 is maintained thus providing greater support for heavier users.

The headrest 14 is connected to the cradle 16 by a second extension rail 34 which is secured thereto by a securing pin 17. The securing pin 17 passes through a securing aperture 15 of the cradle 16 and a securing aperture 33 of the second extension rail 34. The second extension rail 34 further includes a plurality of second locking apertures extending therethrough and along a length thereof. FIG. 9 shows the second extension rail 34 secured in a central position to the cradle 16 by the securing pin 17. The headrest 14 has the connection bracket 40 positioned on the side of the headrest that does not contact a head of the user. The connection bracket 40 is slidably connected to the second extension rail 34 via the second locking pin 38. The user selectively slides the headrest 14 along the length of the second extension rail 34 and upon reaching a desired position, the second locking pin 38 is inserted through a hole in the connection bracket 40 which corresponds to a respective second locking aperture 36 of the second extension rail 34. As shown in FIG. 9, the direction in which the headrest 14 is slidable is represented by the arrow. The headrest 14 is slidable in the direction of the back cushion 12 as well as in a direction away from the back cushion 12. Preferably, the second locking pin 38 is a spring loaded locking pin similar in design and operation to the first locking pin 21 described above.

Additionally, the apparatus 10 further includes at least four support legs 22. Each support leg 22 extends telescopically so as to provide support for the apparatus 10. Also, the apparatus includes at least one handle 24 positioned on a side of the back cushion 12. The at least one handle 24 allows the user to grip the apparatus 10 to provide stability when performing the abdominal exercises.

Figure 10:
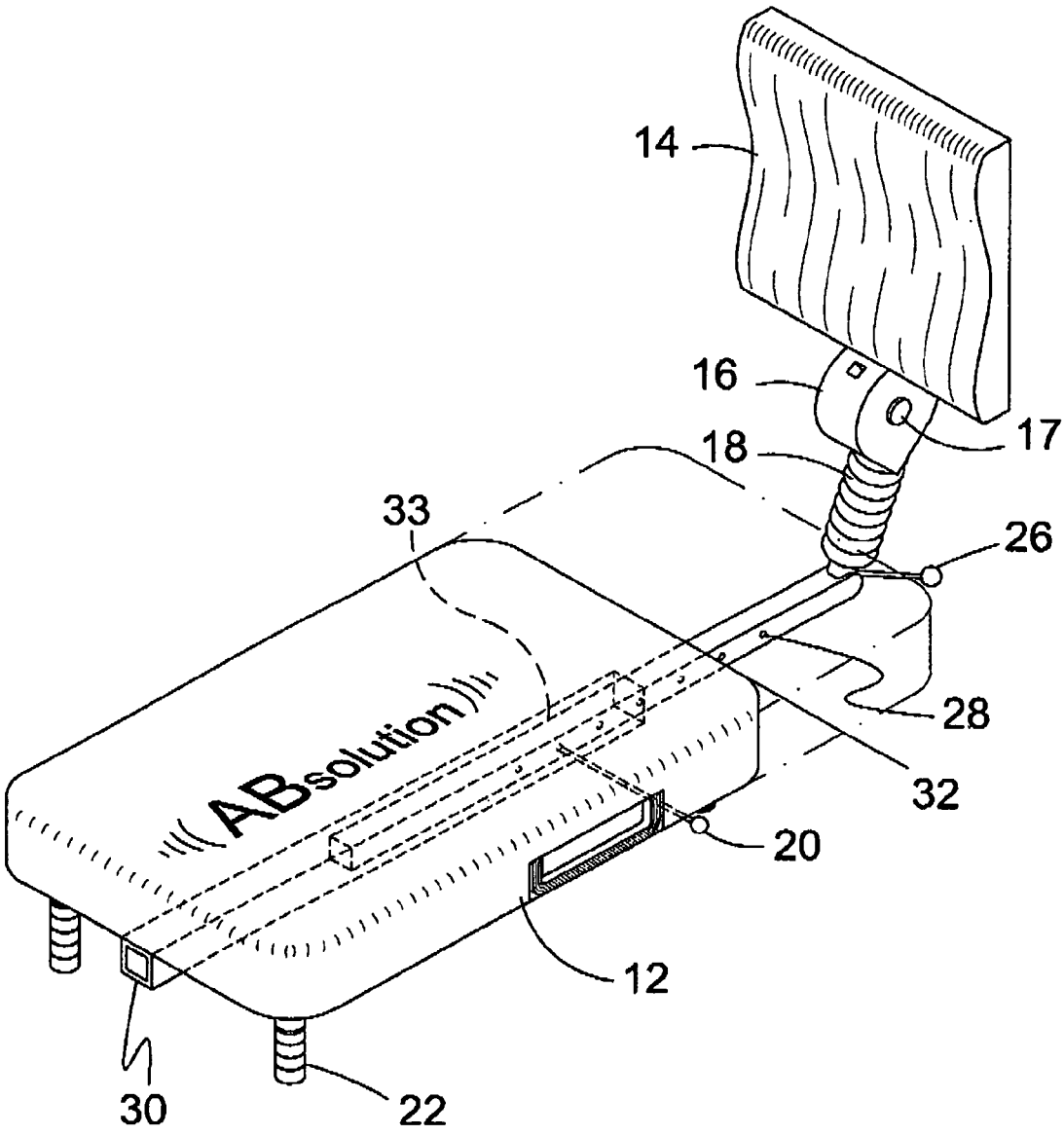
FIG. 10 is a perspective view of the exercise apparatus of the present invention showing the headrest being extended away from the back cushion.
Figure 11:
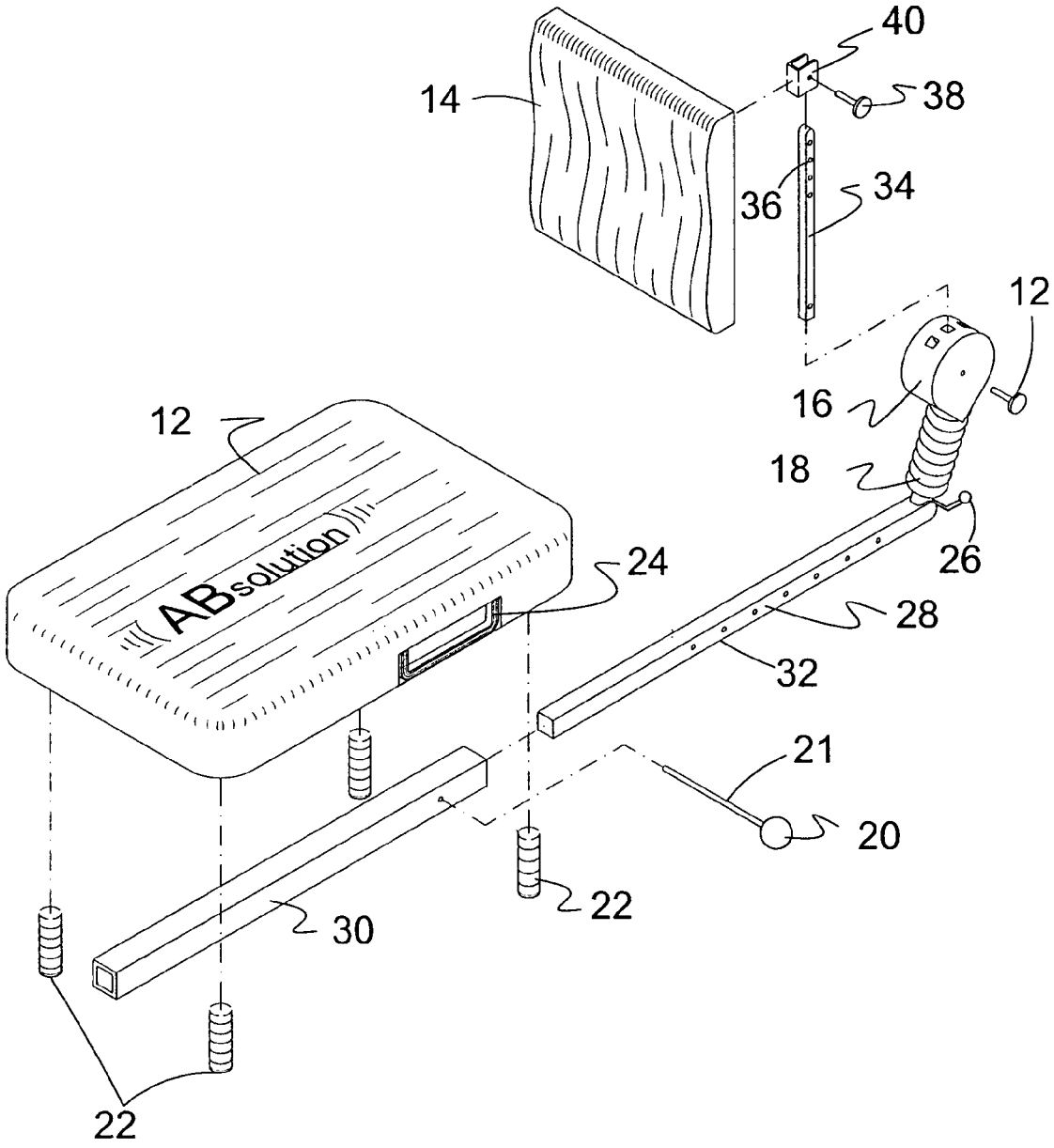
FIG. 11 is an exploded view of the exercise apparatus of the present invention.

FIG. 10 is a perspective view of the exercise apparatus of the present invention showing the headrest being extended away from the back cushion. The apparatus 10 includes the back cushion 12 and the headrest 14 connected via the tension spring 18 and the cradle 16. The tension spring 18 is connected to the first extension rail 28 as shown in FIGS. 4–12. FIG. 4 shows the underside of the apparatus in dotted lines. The first extension rail 28 is received within the guide track 30 and the first extension rail 28 includes the first locking apertures 32 extending therealong. The first extension rail 28 extends outward from the first end of the back cushion 12 and is locked in place by the first adjustment knob 20. The first adjustment knob 20 is connected to the first locking pin 21 as shown in FIG. 11. The first extension rail 28 is moved within the guide track 30 in order to extend the headrest 14 from the first end of the back cushion 12. Upon positioning the headrest 14 at a desired distance from the back cushion 12, the first adjustment knob causes the first locking pin 21 to be received within a respective first locking aperture 32. The first adjustment knob 20 is spring loaded and therefore can be pulled in a direction opposite the apparatus and the first locking pin 21 will be removed from the respective aperture 32. By sliding the first extension rail along the length of the guide track 30, the spring loaded first adjustment knob causes the guide pin 21 to be received within another locking aperture 32. To accommodate various size users, the exercise support apparatus the first extension rail 28 positioned within the guide track 30 adjusts the lateral distance of the headrest 14 from the back cushion 12.

A tension adjustment knob 26 is connected to the tension spring 18 and the first extension rail 28. The tension adjustment knob 26 allows a user to selectively adjust the amount of tension retained by the tension spring 18. This allows different user's having different body weights the ability to use the apparatus 10. The greater the tension of the spring 18 the stiff the position in which the headrest 14 is maintained thus providing greater support for heavier users.

As shown in hereinabove with specific reference to FIGS. 5–9, the headrest 14 is connected to the cradle 16 by a second extension rail 34 which is secured thereto by a securing pin 17. The securing pin 17 passes through a securing aperture 15 of the cradle 16 and a securing aperture 33 of the second extension rail 34. The second extension rail 34 further includes a plurality of second locking apertures extending therethrough and along a length thereof. The second extension rail 34 secured in a central position to the cradle 16 by the securing pin 17. The headrest 14 has the connection bracket 40 positioned on the side of the headrest that does not contact a head of the user. The connection bracket 40 is slidably connected to the second extension rail 34 via the second locking pin 38. The user selectively slides the headrest 14 along the length of the second extension rail 34 and upon reaching a desired position, the second locking pin 38 is inserted through a hole in the connection bracket 40 which corresponds to a respective second locking aperture 36 of the second extension rail 34. As shown in FIG. 9, the direction in which the headrest 14 is slidable is represented by the arrow. The headrest 14 is slidable in the direction of the back cushion 12 as well as in a direction away from the back cushion 12. Preferably, the second locking pin 38 is a spring loaded locking pin similar in design and operation to the first locking pin 21 described above.

Additionally, the apparatus 10 further includes at least four support legs 22. Each support leg 22 extends telescopically so as to provide support for the apparatus 10. Also, the apparatus includes at least one handle 24 positioned on a side of the back cushion 12. The at least one handle 24 allows the user to grip the apparatus 10 to provide stability when performing the abdominal exercises.

FIG. 11 is an exploded view of the exercise apparatus of the present invention. The apparatus 10 includes the back cushion 12 and the headrest 14 connected via the tension spring 18 and the cradle 16. The tension spring 18 is connected to the first extension rail 28 as shown in FIGS. 4–12. FIG. 4 shows the underside of the apparatus in dotted lines. The first extension rail 28 is received within the guide track 30 and the first extension rail 28 includes the first locking apertures 32 extending therealong. The first extension rail 28 extends outward from the first end of the back cushion 12 and is locked in place by the first adjustment knob 20. The first adjustment knob 20 is connected to the first locking pin 21 as shown in FIG. 11. The first extension rail 28 is moved within the guide track 30 in order to extend the headrest 14 from the first end of the back cushion 12. Upon positioning the headrest 14 at a desired distance from the back cushion 12, the first adjustment knob causes the first locking pin 21 to be received within a respective first locking aperture 32. The first adjustment knob 20 is spring loaded and therefore can be pulled in a direction opposite the apparatus and the first locking pin 21 will be removed from the respective aperture 32. By sliding the first extension rail along the length of the guide track 30, the spring loaded first adjustment knob causes the guide pin 21 to be received within another locking aperture 32. To accommodate various size users, the exercise support apparatus the first extension rail 28 positioned within the guide track 30 adjusts the lateral distance of the headrest 14 from the back cushion 12.

A tension adjustment knob 26 is connected to the tension spring 18 and the first extension rail 28. The tension adjustment knob 26 allows a user to selectively adjust the amount of tension retained by the tension spring 18. This allows different user's having different body weights the ability to use the apparatus 10. The greater the tension of the spring 18 the stiff the position in which the headrest 14 is maintained thus providing greater support for heavier users.

The headrest 14 is connected to the cradle 16 by a second extension rail 34 which is secured thereto by a securing pin 17. The securing pin 17 passes through a securing aperture 15 of the cradle 16 and a securing aperture 33 of the second extension rail 34. The second extension rail 34 further includes a plurality of second locking apertures extending therethrough and along a length thereof. The second extension rail 34 secured in a central position to the cradle 16 by the securing pin 17. The headrest 14 has the connection bracket 40 positioned on the side of the headrest that does not contact a head of the user. The connection bracket 40 is slidably connected to the second extension rail 34 via the second locking pin 38. The user selectively slides the headrest 14 along the length of the second extension rail 34 and upon reaching a desired position, the second locking pin 38 is inserted through a hole in the connection bracket 40 which corresponds to a respective second locking aperture 36 of the second extension rail 34. As shown in FIG. 9, the direction in which the headrest 14 is slidable is represented by the arrow. The headrest 14 is slidable in the direction of the back cushion 12 as well as in a direction away from the back cushion 12. Preferably, the second locking pin 38 is a spring loaded locking pin similar in design and operation to the first locking pin 21 described above.

Additionally, the apparatus 10 further includes at least four support legs 22. Each support leg 22 extends telescopically so as to provide support for the apparatus 10. Also, the apparatus includes at least one handle 24 positioned on a side of the back cushion 12. The at least one handle 24 allows the user to grip the apparatus 10 to provide stability when performing the abdominal exercises.

Figure 12:
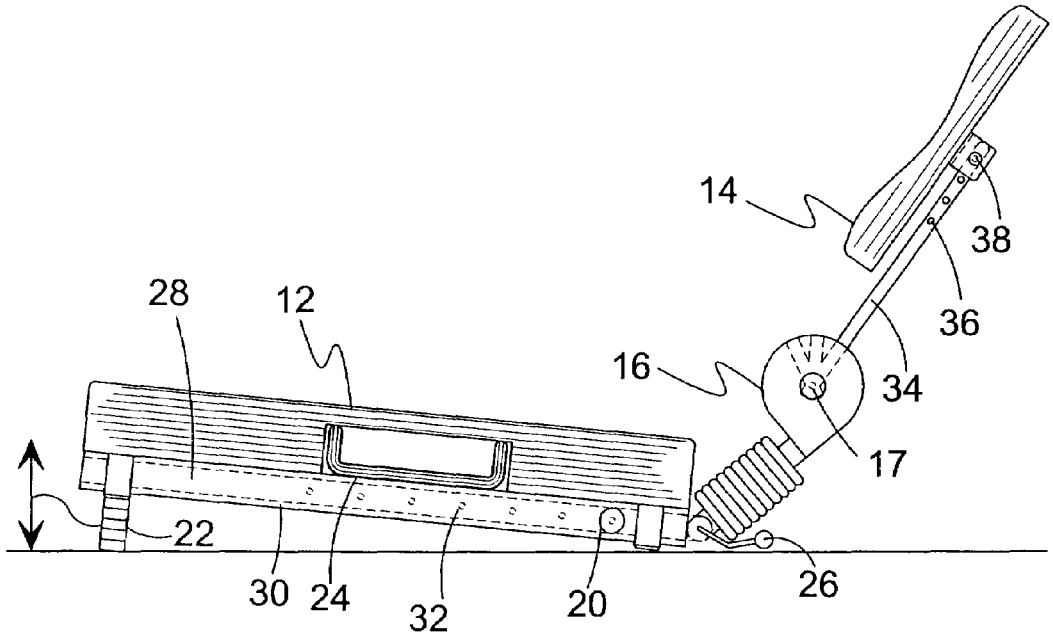
FIG. 12 is a side view of the exercise apparatus with front legs extended.

FIG. 12 is a side view of the exercise apparatus with front legs extended. The apparatus 10 includes the back cushion 12 and the headrest 14 connected via the tension spring 18 and the cradle 16. The tension spring 18 is connected to the first extension rail 28 as shown in FIGS. 4–12. FIG. 4 shows the underside of the apparatus in dotted lines. The first extension rail 28 is received within the guide track 30 and the first extension rail 28 includes the first locking apertures 32 extending therealong. The first extension rail 28 extends outward from the first end of the back cushion 12 and is locked in place by the first adjustment knob 20. The first adjustment knob 20 is connected to the first locking pin 21 as shown in FIG. 11. The first extension rail 28 is moved within the guide track 30 in order to extend the headrest 14 from the first end of the back cushion 12. Upon positioning the headrest 14 at a desired distance from the back cushion 12, the first adjustment knob causes the first locking pin 21 to be received within a respective first locking aperture 32. The first adjustment knob 20 is spring loaded and therefore can be pulled in a direction opposite the apparatus and the first locking pin 21 will be removed from the respective aperture 32. By sliding the first extension rail along the length of the guide track 30, the spring loaded first adjustment knob causes the guide pin 21 to be received within another locking aperture 32.

A tension adjustment knob 26 is connected to the tension spring 18 and the first extension rail 28. The tension adjustment knob 26 allows a user to selectively adjust the amount of tension retained by the tension spring 18. This allows different user's having different body weights the ability to use the apparatus 10. The greater the tension of the spring 18 the stiff the position in which the headrest 14 is maintained thus providing greater support for heavier users.

The headrest 14 is connected to the cradle 16 by a second extension rail 34 which is secured thereto by a securing pin 17. The securing pin 17 passes through a securing aperture 15 of the cradle 16 and a securing aperture 33 of the second extension rail 34. The second extension rail 34 further includes a plurality of second locking apertures extending therethrough and along a length thereof. FIG. 9 shows the second extension rail 34 secured in a central position to the cradle 16 by the securing pin 17. The headrest 14 has the connection bracket 40 positioned on the side of the headrest that does not contact a head of the user. The connection bracket 40 is slidably connected to the second extension rail 34 via the second locking pin 38. The user selectively slides the headrest 14 along the length of the second extension rail 34 and upon reaching a desired position, the second locking pin 38 is inserted through a hole in the connection bracket 40 which corresponds to a respective second locking aperture 36 of the second extension rail 34. As shown in FIG. 9, the direction in which the headrest 14 is slidable is represented by the arrow. The headrest 14 is slidable in the direction of the back cushion 12 as well as in a direction away from the back cushion 12. Preferably, the second locking pin 38 is a spring loaded locking pin similar in design and operation to the first locking pin 21 described above.

Additionally, the apparatus 10 further includes at least four support legs 22. Each support leg 22 extends telescopically so as to provide support for the apparatus 10. Also, the apparatus includes at least one handle 24 positioned on a side of the back cushion 12. The at least one handle 24 allows the user to grip the apparatus 10 to provide stability when performing the abdominal exercises. Shown in FIG. 12 is a side view of the exercise apparatus 10 with telescoping legs 22 extended on lower portion of apparatus to allow greater exercise for the lower abdominal muscles.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An exercise apparatus for use in performing abdominal exercises comprising:

a) a back support member having a first side for supporting a back of a user;

b) a headrest having a first side for resting a head of a user there against;

c) a cradle supporting said headrest and a tension spring directed upwardly from said back support member at an angle between a horizontal surface and ninety degrees from said horizontal surface, said tension spring having one end connected to said cradle and an opposite end connected to said back support member for allowing said cradle and headrest to pivot under a weight of said head of the user and;

d) a first extension connected between said tension spring and said back support member, said first extension comprises:

i) a guide track having a plurality of apertures extending there through along a length thereof positioned on a side of said back support opposite said first side;

ii) a first extension rail having a plurality of apertures extending there through and along a length thereof; and iii) a first locking pin, wherein said first extension rail is received by said guide track, and upon extending said first extension out from a first end of said back support member, and aligning said apertures of said guide track and said first extension rail, said first locking pin is received through each of said aligned apertures thereby locking said first extension in place;

e) a second extension connected between said cradle and said headrest, said second extension comprising:

i) a U-shaped connection bracket positioned on a side of said headrest opposite said first side, said connection bracket having an aperture extending through each wall of said U-shaped bracket;

ii) a second extension rail having a plurality of apertures extending there through and along a length thereof; said rail secured to said cradle by a securing pin which passes through a securing aperture of said cradle and a securing aperture of said second extension rail whereby the second extension rail is securable in a central position to the cradle by the securing pin, or a forward position to the cradle by the securing pin or a back position to the cradle by the securing pin thereby causing the users head to be positioned further from the abdomen thus allowing a user to exercise in a near prone position;

iii) a second locking pin, wherein said connection bracket is slidably connected to said second extension rail and upon positioning said headrest at a desired distance from said cradle and aligning said apertures of the connection bracket and said second extension rail, said locking Din is received through each of said aligned apertures thereby locking said second extension in place and said headrest being pivotable about said second locking pin allowing for an adjustment of an angular position of said headrest.

2. The apparatus as recited in claim 1, further comprising means for adjusting an amount of tension in said tension spring.

3. The apparatus as recited in claim 1, further comprising at least one gripping handle pivotably connected to said back support member for providing stability during abdominal exercises.

4. The apparatus as recited in claim 3, further comprising a plurality of support legs positioned on a side of said back support member opposite said first side of said back support member.

5. The apparatus are recited in claim 4, wherein each of said plurality of support legs extends telescopically from said side opposite said first side of said back support member.

* * * * *